United States Patent [19]

Yu

[11] 4,218,682

[45] Aug. 19, 1980

[54] MULTIPLE BAND CIRCULARLY POLARIZED MICROSTRIP ANTENNA

[76] Inventor: Robert A. Frosch, Administrator of the National Aeronautics and Space Administration, with respect to an invention of I-Ping Yu, Thousand Oaks, Calif.

[21] Appl. No.: 51,270

[22] Filed: Jun. 22, 1979

[51] Int. Cl.[2] ..... H01Q 1/38

[52] U.S. Cl. ..... 343/700 MS; 343/830

[58] Field of Search ..... 343/700 MS, 829, 830, 343/846

[56] References Cited

U.S. PATENT DOCUMENTS

| | | | |
|---|---|---|---|
| 4,089,003 | 5/1978 | Conroy | 343/700 MS |
| 4,131,892 | 12/1978 | Munson et al. | 343/700 MS |
| 4,131,893 | 12/1978 | Munson et al. | 343/700 MS |
| 4,162,499 | 7/1979 | Jones et al. | 343/700 MS |

*Primary Examiner*—Eli Lieberman

*Attorney, Agent, or Firm*—Carl O. McClenny; John R. Manning; Marvin F. Matthews

[57] ABSTRACT

Disclosed is a multiple band antenna assembly for communicating electromagnetic radiation. An antenna element stack is constructed of a plurality of elliptical lamina antenna elements mutually separated by layers of dielectric material, and separated from a ground plane by dielectric material. The antenna assembly is coupled through a feed line in contact with the top antenna element. A conductor joins the remaining antenna elements to the ground plane. Each individual antenna element is operable for communication reception and transmission within a frequency band determined by the size of the particular antenna element. The antenna elements are arranged in order of decreasing size with the largest antenna element closest to the ground plane. The sizes of the antenna elements may be selected to provide electromagnetic radiation communication over several distinct frequency bands, or to connect the individual bands into a broad band.

20 Claims, 3 Drawing Figures

MULTIPLE BAND CIRCULARLY POLARIZED MICROSTRIP ANTENNA

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. Field of the Invention

The present invention pertains to antennas for transmitting and/or receiving electromagnetic radiation. More particularly, the present invention relates to techniques for communicating polarized radiation in broad frequency bands or multiple frequency bands by using antenna assemblies of microstrip construction.

2. Description of Prior Art

The use of antennas for both transmitting and receiving electromagnetic radiation is well known. A variety of approaches to antenna construction is followed, with a particular antenna design selected generally on the basis of several factors. These factors may include, among others, the frequency range in which the antenna is to function, physical size limitations on the antenna, mobility requirements, if any, the radiation pattern desired, and the nature and degree of the polarization of the radiation to be communicated. All of these factors are particularly critical when the antenna in question is mounted for operation on an aircraft or spacecraft. In such case, for example, the antenna must generally be small and lightweight and able to function at a variety of orientations of the craft relative to the ground, and the station with which the craft is communicating. Also, the aerodynamic design features of the antenna may be critical on a craft intended to move through the atmosphere at high speed. Particularly in the case of a spacecraft, located at high altitudes and communicating with a ground level station, polarization effects can reduce signal strength significantly. For example, waves polarized in one direction relative to the plane of incidence of a wave front reflecting at a boundary between atmospheric layers may undergo a phase change, while waves polarized at a different angle may not experiencing a phase change. An interference pattern may then result with a spacecraft experience fluctuating signal strength as the antenna is moved through a pattern of nodes.

My co-pending U.S. Pat. Application Ser. No. 750,796, filed Dec. 15, 1976 discloses an antenna assembly including an antenna element that is an elliptical lamina in shape and is separated from a ground plane by a dielectric lamina. The frequency range within which the antenna assembly is operable for communication of electromagnetic radiation is determined by the size of the antenna element. The polarization of the electromagnetic radiation is determined by the location of the feed point on the antenna element through which the assembly is coupled, with respect to the axes of the elliptical lamina.

U.S. Pat. No. 4,060,810 discloses an antenna assembly including two planar antenna elements, one generally circumscribing the other. Each antenna element is operable within a different frequency range, to provide a two-frequency antenna assembly.

U.S. Pat. No. 3,665,480 discloses the use of multiple antenna elements to reform the radiation pattern of a single signal. U.S. Pat. No. 3,854,140 discloses an antenna array for communicating two beams at different frequencies.

Microstrip antennas, particularly those operating to communicate circularly polarized radiation, have been generally characterized by narrow bandwidth operation. Consequently, such antennas are substantially single-frequency antennas.

SUMMARY OF THE INVENTION

An antenna assembly according to the present invention is operable for transmitting and/or receiving electromagnetic radiation over a broad frequency band, or over several frequency bands, as selected. The radiation is generally elliptically polarized but, by appropriate antenna coupling, the present invention may be used to communicate right-circularly polarized radiation or left-circularly polarized radiation. The frequency range in which the antenna assembly is operable is selectible by constructing the antenna elements of the assembly in appropriate sizes.

An antenna assembly according to the present invention is preferably provided to include a stack of antenna elements positioned above a ground plane and separated therefrom by dielectric material. Each antenna element is generally in the form of an elliptical lamina of electrically conducting material. The antenna elements are also separated from each other by dielectric material.

Each antenna element is operable within a frequency band determined by the size of the particular element. The frequencies over which an antenna element is operable increase as the size of the element is decreased. The semimajor axis of each elliptical antenna element is selected according to the frequency band communication desired, with each antenna element thus of a different size. The antenna elements are positioned in a stack one above the other arranged in sequence according to size, with the smallest antenna element farthest from the ground plane.

The antenna assembly may be connected to appropriate receiving and/or transmitting equipment by means of a feed line joined to the smallest antenna element at a selected feed point. With the feed point considered to lie along a radial line of the smallest elliptical antenna element, the degree and sense of elliptical polarization of the electromagnetic radiation communicable by the antenna assembly is determined by the azimuthal angle of the feed point radius line relative to a semimajor axis of the elliptical lamina. Circularly polarized radiation is communicable by means of the antenna assembly when the feed point lies along a radius of azimuthal angle 45° relative to a semimajor axis of each antenna element.

The connector to the smallest antenna element is insulated from the remaining antenna elements. A conducting pin joins the remaining antenna elements to the ground plane along a straight line perpendicular to the ground plane and passing through the centers of the antenna elements. Thus, the highest frequency antenna element is fed directly by the connector in the transmit mode, and similarly feeds the received signal directly by way of the connecting line to the receiver. The remaining antenna elements are coupled, by capacitive effects, ultimately by way of the smallest antenna element for both receiving and transmitting signals.

By appropriately varying the sizes of the individual antenna elements, an antenna assembly is provided for communication within several individual frequency bands. With the relative sizes of the antenna elements sufficiently close in value, the individual frequency bands of the corresponding antenna elements may be made to be contiguous or overlap to provide a single broad frequency band within which the antenna assembly is operable for communication of electromagnetic radiation.

In a method of the present invention, an antenna assembly is provided in the form of a stack of elliptical lamina antenna elements separated from each other and from a ground plane by dielectric layers. The sizes of the individual antenna elements are selected to provide antenna elements operable within desired frequency ranges. The antenna elements are stacked in order of decreasing size with the smallest antenna element farthest from the ground plane. The antenna assembly is coupled at a feed point located on a radial line of the smallest antenna element, with the remaining antenna elements all electrically connected along a central line of the assembly to the ground plane. The location of the feed point on the top antenna element is selected to achieve the desired nature and degree of polarization of the electromagnetic radiation to be communicated. An antenna assembly according to the present invention may be constructed as a microstrip antenna, with multiple layers of antenna elements and dielectric material stacked above a ground plane of electrically conducting material.

An antenna assembly according to the present invention may be used within the generally limited confines of a spacecraft to provide a capability for communicating circularly polarized radiation over a broad range of frequencies. The dimensions of an antenna assembly constructed according to the present invention for operation in the microwave region are in the range of a few centimeters. Thus, such an antenna assembly, particularly when constructed as a microstrip antenna, is extremely lightweight and small.

It will be appreciated that an antenna assembly according to the present invention is of the low-profile type, particularly suited in its aerodynamic and mechanical structure for placement on the exterior of a spacecraft or aircraft. Further, the present invention provides an antenna assembly which may be constructed relatively inexpensively, though it may be made rugged structurally. Also, although such an antenna assembly may be of relatively simple design and construction, the present invention provides a compact antenna assembly which may be of microstrip construction and which is operable for communication over a broad range of frequencies.

DESCRIPTION OF PREFERRED EMBODIMENTS

Figure 1:
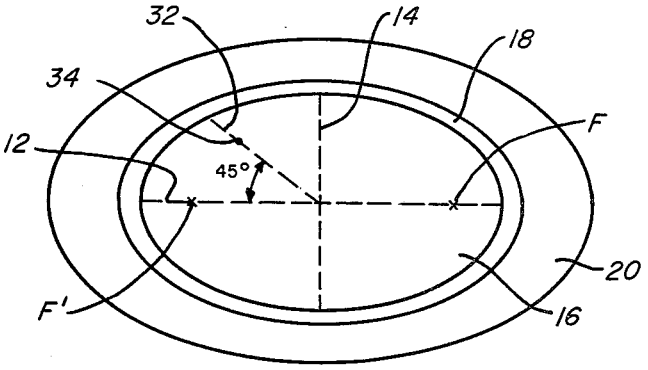
FIG. 1 is a plan view of an antenna element stack of an antenna assembly according to the present invention.
Figure 2:
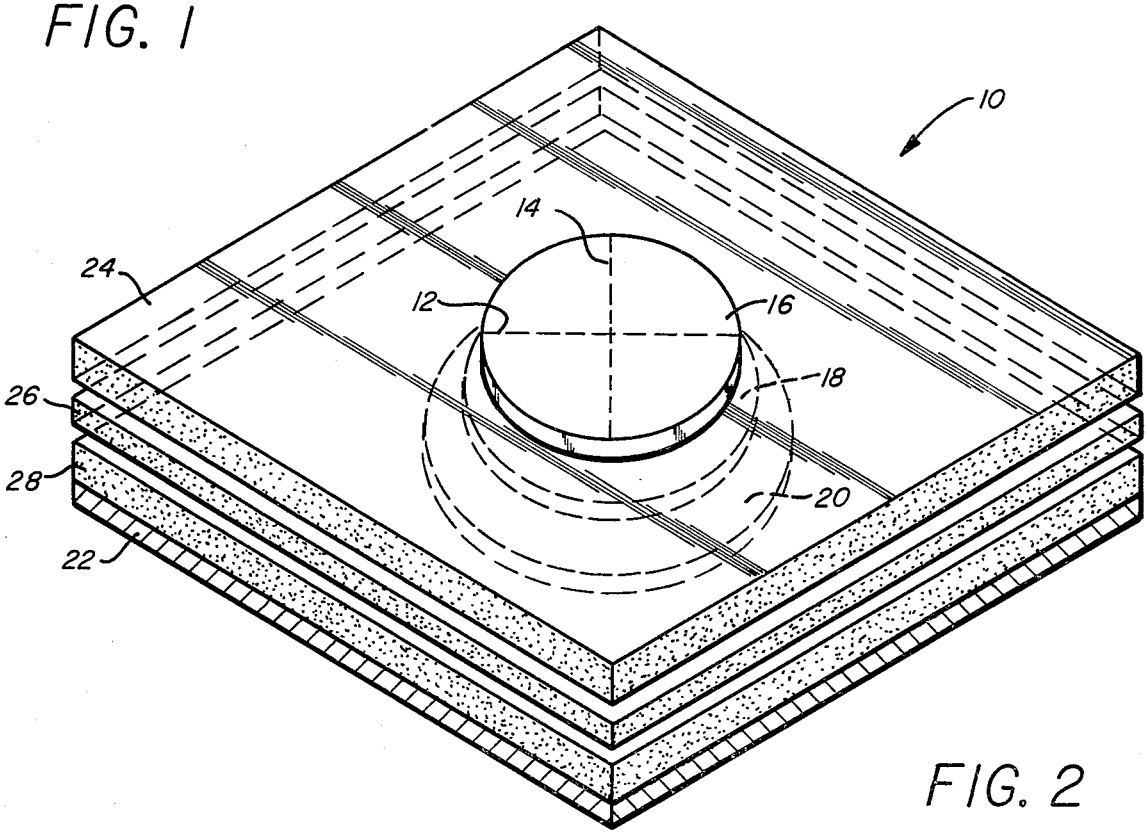
FIG. 2 is a perspective view of a laminar unit showing the antenna assembly in microstrip form.

An antenna assembly according to the present invention is shown generally at 10 in FIG. 2, and includes a stack, or array, of antenna elements which are in the form of elliptical laminae. A plan view of the antenna element stack is illustrated in FIG. 1. Radial lines 12 and 14 identify a semimajor axis "a" and a semiminor axis "b", respectively, of the top antenna element 16. F and F′ are the foci of the elliptical element 16.

As may be appreciated by reference to FIGS. 1–3, the antenna assembly 10 includes two additional antenna elements 18 and 20 positioned below the antenna element 16. Each elliptical antenna element 16, 18 and 20 features a different length semimajor axis. However, as discussed in further detail hereinafter, the eccentricities of the antenna elements are all within the same range. Thus, the overall sizes of the antenna elements 16–20 vary approximately as their semimajor axes.

The stack of three antenna elements 16–20 is positioned above a ground plane 22. The antenna elements 16–20 are stacked in order of length of semimajor axis, with the antenna element 16 having the smallest semimajor axis being placed farthest from the ground plane 22. The geometric centers of all the antenna elements 16–20 lie generally along a straight line perpendicular to the ground plane 22.

The antenna elements 16–20 and the ground plane 22 are constructed of electrically conducting material, such as copper. A layer of dielectrical material 24 separates the first and second antenna elements, 16 and 18, respectively. A second layer of dielectric material separates the second and third antenna elements, 18 and 20, respectively. A third layer of dielectric material 28 separates the antenna element stack from the ground plane 22. As discussed in further detail hereinafter, the selection of materials for the dielectric layers 24–28 is determined, at least in part, by the frequencies over which the antenna assembly 10 is to be operable.

Figure 3:
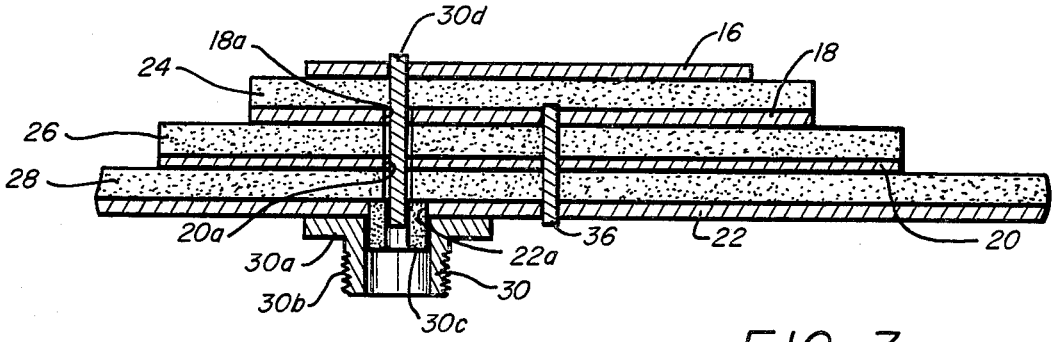
FIG. 3 is a cross-sectional view of a laminar segment illustrating the microstrip construction of the antenna assembly and the direct coupling of the antenna at a feed point as well as the electrical connection between the ground plane and the lower two antenna elements.

As may be appreciated by reference to FIG. 3, a connector 30 provides electrical contact to the top antenna element 16 through the ground plane 22, the lower antenna elements 18 and 20, and the dielectric layers 24–28. A fixture **30*a* is bonded to the ground plane 22. A threaded neck 30*b* extends from the fixture 30*a* to provide a threaded joint with a connecting cable (not shown). An insulating sleeve 30*c* lines a circular hole within the fixture 30*a* as well as a portion of the neck 30*b*, and extends through a hole 22*a* in the ground plane 22 to contact the adjacent dielectric layer 28. A conducting pin 30*d* protrudes through holes 20*a* and 18*a* in the antenna elements 20 and 18, respectively, as well as appropriate holes in the dielectric layers 26 and 24. The conducting pin 30*d* contacts the top antenna element 16. A matching cable connector (not shown) may be joined to the connector 30 to provide an electrical connection from the antenna element 16 through the pin 30*d***, and along an electrical conducting element within the cable to a transmitter and/or receiver (not shown).

The connector 30 provides a coupling of the antenna assembly 10 at a feed point on the antenna element 16. The location of the feed point on the element 16 may best be discerned by reference to FIG. 1. The feed point to the antenna element 16 is located on a radius 32 of that antenna element. As indicated in FIG. 1, the radial line 32 is oriented at an azimuthal angle of 45° relative to a semimajor axis 12 of the antenna element 16. It has been determined that the location of the feed point on the antenna element affects the polarization of the radiation generated through the antenna element or receivable thereby.

Generally, the radiation produced with an elliptical antenna element such as 16 is elliptically polarized, as is the radiation receivable thereby. This is true because of the nature of the elliptical shape of the antenna element. During operation of the antenna element, electrical currents are induced to circulate about the antenna element. These currents are generated either by a signal conducted through the feed line from a transmitting circuit (not shown), for transmission to a remote receiver, or by a signal received from a remote transmitter (not shown) and relayed through the feed point to a receiving circuit (not shown). The currents excite two distinct and independent types of radiation modes on the elliptical antenna element, i.e., odd and even modes. Both lowest odd and even modes dominate the radiation characteristics of the antenna element. Within the limitation of the eccentricity of the ellipse, the magnitudes of these two radiation modes are almost equal and the modes are 90° out of phase. Thus, the elliptical polarization radiation characteristic is formed by these two modes. Consequently, the polarization of the radiation in question is affected by the location of the feed point relative to the semimajor axes "a", here lying along the radial line 12. In general, the elliptical polarization is varied as the feed point position is moved about an azimuthal angle in the plane of the ellipse. However, the special case of circularly polarized radiation may be achieved by placing the feed point on any radial line positioned at an azimuthal angle of 45° relative to a semimajor axis.

If the feed point is located on a radial line at a 45° angle measured counterclockwise from a semimajor axis, such as the axis 12 of the antenna element 16, the radiation in question will be left-circularly polarized. Similarly, if the feed point is located on a radial line oriented at a 45° angle measured clockwise from a semimajor axis of the antenna element, the radiation in question will be right-circularly polarized. Thus, for example, with the feed point of the antenna element 16 as indicated in FIG. 1 at a point 34 along the radial line 32 at a clockwise 45° azimuthal angle relative to a semimajor axis, such as 12, the electromagnetic radiation transmitted by the antenna element 16, or receivable thereby, is right-circularly polarized.

A conducting pin 36 joins the centers of all the remaining antenna elements to the ground plane 22. Thus, an electrical connection is provided between the antenna elements 18 and 20, and the ground plane 22, by the conducting pin 36 lying generally along the line perpendicular to the ground plane and passing through the geometric centers of the elliptical antenna elements 18 and 20. Then, the middle antenna element 18 functions as a ground plane relative to the top antenna element 16. The separation of the two antenna elements 16 and 18 by the dielectric layer 24 provides a cavity for the top antenna element. At the same time, a capacitive effect is present between the top antenna element 16 and the next antenna element 18 to provide a coupling between these two antenna elements. Then, signals received from a remote station by the antenna element 18 are communicated to the connector 30 by means of the capacitive coupling between the antenna elements 18 and 16. Similarly, the signals to be transmitted by the antenna element 18 are communicated thereto by means of the coupler 30, the antenna element 16 and the capacitive coupling between the antenna elements 16 and 18.

Similarly, the lowest antenna element 20 functions as a ground plane relative to the middle antenna element 18. A cavity is effected by the separation between the antenna elements 18 and 20. At the same time, a capacitive coupling is provided between the two antenna elements 18 and 20, separated by the dielectric layer 28. Then, signals received from a remote station by the lowest antenna element 20 are communicated, ultimately to the connector 30, by the capacitive coupling between the antenna elements 20 and 18, and by the capacitive coupling between the antenna elements 18 and 16. Signals to be transmitted by the antenna element 20 are fed to the antenna assembly 10 by the connector 30 to the top antenna element 16, and then to the antenna element 20 by way of the capacitive couplings between the antenna elements 16 and 18, and between the antenna elements 18 and 20. The cavity necessary for the operation of the lowest antenna element 20 to operate is provided by the separation of that antenna element from the ground plane 22.

The electric currents generated on the antenna elements 16, 18 and 20 are generally concentrated at the peripheries of the individual antenna elements. The current at the geometric center of such an antenna element is zero in both the receive and transmit modes. Consequently, no loss in signal strength or operating efficiency may be expected by linking the lower antenna elements 18 and 20 to the ground plane by the conducting pin 36 at the geometric centers of the antenna elements.

The frequency range at which an antenna element such as 16 operates is determined by the size of the antenna element 16 and the dielectric constant of the dielectric layer 24 in the cavity of the antenna element 16. To achieve an operating frequency f, the semimajor axis "a" of the ellipse of the antenna element in question is given by the equation $$a = kv_o/f(\epsilon)^{\frac{1}{2}} \quad (1)$$

where $\epsilon$ is the relative dielectric constant of the layer 24, $v_o$ is the speed of electromagnetic radiation, and k is an empirical constant ranging from 0.27 to 0.29. Consequently, by decreasing the semimajor axis of the ellipse, the operating frequency f is made larger.

It has been found that the desired circularly polarized radiation communicability may best be achieved by limiting the eccentricity "e" of the ellipse to a range of 10 to 20%. Since the semimajor axis "a" and the semiminor axis "b" are related to the eccentricity by the equation $$b = a(1-e^2)^{\frac{1}{2}}, \quad (2)$$

both axes of the elliptical antenna element 16 are limited by these two equations and the limitation on the value of the eccentricity.

The same equations (1) and (2), and the limitation of eccentricity to 10 to 20%, may be applied to each of the antenna elements individually. Thus, for example, the operating frequency of the middle antenna element 18 is determined by the size of its semimajor axis and the relative dielectric constant of the dielectric layer 26. The operating frequency of the lowest antenna element is determined by the size of its semimajor axis and the relative dielectric constant of the layer 28. Maintaining the 10 to 20% limitation on the eccentricity of a given elliptical antenna element insures that the antenna element is operable to communicate electromagnetic radiation that is circularly polarized.

Since the operating frequency of an antenna element varies inversely as the semimajor axis of the antenna element, the highest operating frequency will be provided by the smallest antenna element at the top of the stack, assuming no large variation in the values of the relative dielectric constant among the dielectric layers 24–28. Then, the lowest antenna element in the stack, being the largest in size, will operate at the lowest frequency.

Each antenna element is operable to communicate electromagnetic radiation in a relatively narrow frequency band determined by physical characteristics of that particular antenna element and its related cavity dielectric material, as noted hereinabove. Consequently, the combination of the antenna elements 16–20 provides an antenna assembly capable of communicating electromagnetic radiation on three distinct bands whose frequencies are determined as described. However, the antenna assembly 10 may be constructed, by appropriately selecting the sizes of the antenna elements 16–20 and the values of the relative dielectric constants of the dielectric layers 24–28, to adjoin or overlap the frequency bands of the individual antenna elements. In that case, the antenna assembly 10 is operable over a single broad frequency band whose range is determined by the lower limit of the frequency band of the lowest operating frequency antenna element, 20, and the upper limit of the frequency band of the highest operating frequency antenna element 16.

It will be appreciated that, although only three antenna elements are shown herein, any number of antenna elements may be included in the stack of the antenna assembly. All antenna elements in the stack, except the top antenna element, are electrically connected, at their geometric centers, to the ground plane. The top antenna element is joined to external receiving and/or transmitting equipment by a connector such as 30. Capacitive coupling joins all the remaining antenna elements to the connector. Each antenna element below the top antenna element functions as a ground plane for the next higher antenna element in the stack, with the dielectric material separating such adjacent antenna elements determining, in part, the operating frequency band of the higher of the two antenna elements. The ground plane itself defines, in part, the cavity for the lowest antenna element in the stack, while the dielectric material separating this antenna element from the ground plane determines, in part, the operating frequency band of the lowest antenna element.

Since virtually any number of antenna elements may be included in the antenna assembly, with each antenna element operable in its own selected frequency band, the present invention provides an antenna assembly operable over any number of chosen frequency bands. Also, by constructing the antenna assembly so that all of the frequency bands of the individual antenna elements adjoin or overlap, the band within which the antenna assembly is operable may be made as broad as desired by including a sufficient number of antenna elements of appropriate size and with appropriate dielectric materials within their respective cavities. It will also be appreciated that any desired combination of broad bands and narrow bands may be achieved for the operability of an antenna assembly according to the present invention by appropriately selecting the operating frequency bands of the individual antenna elements in the stack.

The antenna assembly of the present invention may be constructed as a microstrip antenna. Such construction may be begun, for example, with a collection of laminar units with each unit composed of a conducting layer deposited on, or bonded to a substrate of dielectric material. Material from the conducting layer of such a unit may be selectively removed until the desired elliptical lamina shape appears, in the size desired for a particular antenna element. Holes may be drilled in the laminar units to accomodate the connection to the top antenna element, and connection between the remaining antenna elements and the ground plane. With all antenna elements thus formed, the laminar units are stacked on a conducting layer forming the antenna assembly ground plane, with the antenna elements all centered one above the other, and arranged in sequence of decreasing size proceeding away from the ground plane. The conducting pin joining all antenna elements, except the top antenna element, to the ground plane may be inserted before the top antenna element laminar unit is placed on the stack. The connector for the top antenna element is inserted to complete the antenna assembly construction.

It is possible to construct the antenna assembly 10 by supporting one or more of the antenna elements spaced apart from the ground plane 22 and/or adjacent antenna elements, with a gas or vacuum serving as the dielectric layer between conducting materials. However, solid dielectric substrates are required to effect the present invention by the methods of construction of the antenna assembly discussed hereinbefore.

The present invention provides an antenna assembly of the low-profile, microstrip type, operable, in the microwave region, for example, over a wide band of frequencies, or over a multiple of frequency bands, or over a combination of multiple frequency bands of varying breadths.

The foregoing disclosure and description is illustrative and explanatory thereof, and various changes in the method steps as well as in the details of the illustrated apparatus may be made within the scope of the appended claims without departing from the spirit of the invention.

We claim:

1. An antenna assembly for communicating electromagnetic radiation comprising:

(a) ground plane means;

(b) first antenna element means, for communicating at a first frequency band, comprising a generally elliptical lamina of electrically conducting material, separated from said ground plane means;

(c) second antenna element means, for communicating at a second frequency band, comprising a generally elliptical lamina of electrically conducting material, positioned generally between said first antenna element means and said ground plane means, and separated from both said first antenna element means and said ground plane means;

(d) feed means, comprising electrical conducting means contacting said first antenna element means at a feed point, communicating through, said electrically insulated from, said second antenna element means and said ground plane means; and (e) conducting means for electrically connecting said second antenna element means with said ground plane means.

2. An antenna assembly as defined in claim 1 wherein said first antenna element means, said second antenna element means and said ground plane means lie generally in separate mutually parallel planes.

3. An antenna assembly as defined in claim 2 further comprising dielectric means electrically insulating said first antenna element means from said second antenna element means, and said second antenna element means from said ground plane means.

4. An antenna assembly as defined in claim 3 or, in the alternative, as defined in claim 1 wherein the geometric centers of each of said first and second antenna element means lie generally along a straight line perpendicular to said ground plane means.

5. An antenna assembly as defined in claim 4 wherein said conducting means contacts said second antenna element means generally at the geometric center of said second antenna element means.

6. An antenna assembly as defined in claim 5 wherein said feed point lies on a radial line of said first antenna element means, which radial line is oriented at an azimuthal angle of 45° relative to a semimajor axis of said first antenna element means.

7. An antenna assembly as defined in claim 1 further comprising third antenna element means, for communicating at a third frequency band, comprising a generally elliptical lamina of electrically conducting material, positioned generally between said second antenna element means and said ground plane means, and separated from both said second antenna element means and said ground plane means.

8. An antenna assembly as defined in claim 7 wherein said first, second and third antenna element means, and said ground plane means lie generally in separate mutually parallel planes.

9. An antenna assembly as defined in claim 8 further comprising dielectric means electrically insulating said first antenna element means from said second antenna element means, and second antenna element means from said third antenna element means, and said third antenna element means from said ground plane means.

10. An antenna assembly as defined in claim 9 or, in the alternative, as defined in claim 7 wherein the geometric centers of each of said first, second and third antenna element means lie generally along a straight line perpendicular to said ground plane means.

11. An antenna assembly as defined in claim 10 wherein said conducting means contacts said second and third antenna element means generally at the geometric center of each of said second and third antenna element means.

12. An antenna assembly as defined in claim 11 wherein said feed point lies on a radial line of said first antenna element means, which radial line is oriented at an azimuthal angle of 45° relative to a semimajor axis of said first antenna element means.

13. An antenna assembly as defined in claim 7 wherein at least two of said first, second and third frequency bands are contiguous in frequency value.

14. An antenna assembly as defined in claim 1 wherein said first and second frequency bands are contiguous.

15. An antenna assembly for communicating generally elliptically polarized electromagnetic radiation comprising:

(a) a ground plane;

(b) a plurality of antenna elements, each in the form of a generally elliptical lamina of electrically conducting material, and a like plurality of dielectric layers, with the dielectric layers and the antenna elements arranged in a stack with the ground plane, with a dielectric layer adjacent the ground plane and the dielectric layers and the antenna elements arranged in alternating order, and with the antenna elements arranged in order of decreasing size of semimajor axis relative to the ground plane, the geometric center of all the antenna elements lying generally along a straight line perpendicular to the ground plane;

(c) a feed line connected, at a feed point, to the antenna element of smallest semimajor axis; and (d) conducting means connecting the ground plane to the centers of all of the antenna elements except the antenna element of smallest semimajor axis.

16. An antenna assembly as defined in claim 15 wherein at least two of said antenna elements are operable for communicating electromagnetic radiation over frequency bands that are contiguous.

17. A method of communicating electromagnetic radiation comprising the steps of:

(a) providing a plurality of antenna elements, each of electrically conducting material and in the form of a generally elliptical lamina;

(b) providing a ground plane of generally conducting material;

(c) stacking said antenna elements and said ground plane with said antenna elements arranged in order of decreasing size of semimajor axis relative to the ground plane, and with dielectric layers alternating with said ground plane and said antenna elements in said stack;

(d) connecting said ground plane with the geometric centers of the elliptical laminae of said plurality of antenna elements, except for the antenna element farthest from said ground plane; and (e) connecting a feed line to the antenna element farthest from said ground plane.

18. A method as defined in claim 17 further comprising the following steps:

(a) providing laminar material comprising a layer of electrically conducting material adjacent a layer of dielectric material;

(b) selectively removing conducting material to form one of said plurality of antenna elements and one of said dielectric layers; and (c) repeating steps (a) and (b) herein to provide the remainder of said plurality of said antenna elements, and to provide the remainder of said dielectric layers.

19. A method as defined in claim 17 further comprising the steps of providing said antenna elements in selected sizes so as to be operable for communicating electromagnetic radiation in selected frequency bands.

20. A method as defined in claim 19 further comprising the steps of so selecting said sizes of said antenna elements so that at least two of said frequency bands are contiguous.

* * * * *